US007328552B2

(12) United States Patent
Lackey et al.

(10) Patent No.: US 7,328,552 B2
(45) Date of Patent: Feb. 12, 2008

(54) METHOD OF PACKAGING ARTICLES FOR SHIPMENT, STORAGE AND DISPLAY

(75) Inventors: Robert W. Lackey, Hickory, NC (US); Roy V. Nicholson, Blowing Rock, NC (US)

(73) Assignee: RWL Corporation, Hickory, NC (US)

( * ) Notice: Subject to any disclaimer, the term of this patent is extended or adjusted under 35 U.S.C. 154(b) by 245 days.

(21) Appl. No.: 11/122,386

(22) Filed: May 5, 2005

(65) Prior Publication Data

US 2005/0188656 A1 Sep. 1, 2005

Related U.S. Application Data

(62) Division of application No. 10/659,526, filed on Sep. 9, 2003, now Pat. No. 6,923,326.

(51) Int. Cl.
*B35B 43/08* (2006.01)

(52) U.S. Cl. ..... 53/456; 53/467; 53/476; 53/484; 53/173

(58) Field of Classification Search ..... 53/456, 53/458, 467, 473, 476, 480, 484, 173, 175, 53/285

See application file for complete search history.

(56) References Cited

U.S. PATENT DOCUMENTS

| | | | | | |
|---|---|---|---|---|---|
| 2,479,453 | A | * | 8/1949 | Amatel | 206/723 |
| 2,506,057 | A | * | 5/1950 | Bergstein | 229/122.33 |
| 2,676,123 | A | | 4/1954 | Baird | 206/526 |
| 2,725,978 | A | | 12/1955 | Calabrese | 206/45 |
| 2,874,524 | A | * | 2/1959 | Ringler | 53/449 |
| 2,950,004 | A | * | 8/1960 | Acomb | 206/349 |
| 3,035,380 | A | * | 5/1962 | Leavens | 53/458 |
| 3,417,861 | A | | 12/1968 | Levy | 206/45.28 |
| 3,424,595 | A | * | 1/1969 | Tolman | 426/124 |
| 3,485,007 | A | * | 12/1969 | Mackendrick | 53/456 |
| 3,858,717 | A | | 1/1975 | Peters | 206/44.12 |
| 4,363,821 | A | * | 12/1982 | VanderLugt, Jr. | 426/393 |
| 4,567,981 | A | | 2/1986 | Headon | 206/597 |
| 4,762,226 | A | | 8/1988 | Gatton | 206/320 |
| 5,175,041 | A | | 12/1992 | Webb et al. | 428/116 |
| 5,249,669 | A | | 10/1993 | Resnick et al. | 206/45.15 |
| 5,370,233 | A | | 12/1994 | Schutz | 206/597 |
| 5,509,533 | A | | 4/1996 | Veenstra | 206/425 |
| 5,657,872 | A | | 8/1997 | Leftwich et al. | 206/738 |
| 5,706,953 | A | | 1/1998 | Polvere | 206/736 |
| 5,850,922 | A | | 12/1998 | Fraser | 206/736 |
| 5,866,181 | A | | 2/1999 | Hill | 426/107 |

* cited by examiner

*Primary Examiner*—Sameh H. Tawfik
(74) *Attorney, Agent, or Firm*—Charles L. Schwab; Nexsen Pruet, LLC

(57) ABSTRACT

A method of packaging merchandise items for shipment and display provides a box shaped merchandising container is formed including an enclosure with four quadrilateral sides and open top and a bottom closed by flaps. In preparation for shipment, the merchandise is loaded into an open bottom end of the container, opposite the end in which an information panel is installed, and then a removable cap is installed. The product information panel at a top corner of the enclosure is exposed when an enclosure cap is removed from that end of the enclosure. The information panel disposed at a corner of the rectangular open end of the enclosure is dimensioned to permit flat merchandise, such as home type air filters, to be withdrawn from the enclosure without destructive effect on the information panel when the closure cap is removed from the container.

3 Claims, 4 Drawing Sheets

METHOD OF PACKAGING ARTICLES FOR SHIPMENT, STORAGE AND DISPLAY

RELATED APPLICATIONS

This is a divisional patent application of U.S. patent application Ser. No. 10/659,526 filed Sep. 9, 2003 for a Storage and Merchandising Container; now U.S. Pat. No. 6,923,326.

BACKGROUND OF THE INVENTION

The invention relates to a method of packaging merchandise articles for shipment and display. Efficient movement of goods from point of manufacture to display in the merchants facility and then to the purchaser reduces the cost of the goods to the ultimate user. The cut case display of goods is increasing favored because the goods can be moved to and displayed at the merchant's display area more efficiently and the goods are better protected during movement and while on display. U.S. Pat. No. 5,509,533 issued Apr. 23, 1996 to H. Veenstra for a Package for Storing and Displaying a Plurality of Box-Shaped Articles, More Particularly Data Carriers Such as Floppy Disks and the Like discloses a display container which includes a plurality of sheathes for receiving box shaped articles such as floppy disks and which permit product display in the style of overlapping roof tiles. U.S. Pat. No. 5,249,669 issued Oct. 5, 1993 to M. Resnick et al. for a Display Container shows a container which has an upper top opening compartment and a lower sliding drawer. U.S. Pat. No. 3,858,717 issued Jan. 7, 1975 to L. Peters for a Container for Perishable Foods discloses a merchandising container for perishable foods which is equipped with pull tabs to aid in removal of items from shelves of the container. U.S. Pat. No. 5,370,233 issued Dec. 6, 1994 to Rudolph W. Schutz et al. for a Product Shipping and Display System discloses a system of transporting a plurality of shipping and display assemblies on a pallet which permits merchandising from the pallet or removal and display on an individual basis.

SUMMARY OF THE INVENTION

This invention provides a unique method of packaging merchandise articles for shipment, storage and display. The method is particularly suited for packaging home type air filters, in which case the method preferably includes the step of providing an information panel in one corner of an opening which is exposed when the selling merchant removes an end cap from the container. The information panel is dimensioned and positioned to allow a customer to withdraw individual items, such as filters, from the container.

BRIEF DESCRIPTION OF THE DRAWINGS

One embodiment of the invention is illustrated in the accompanying drawings in which.

DETAILED DESCRIPTION OF THE INVENTION

Figure 1:
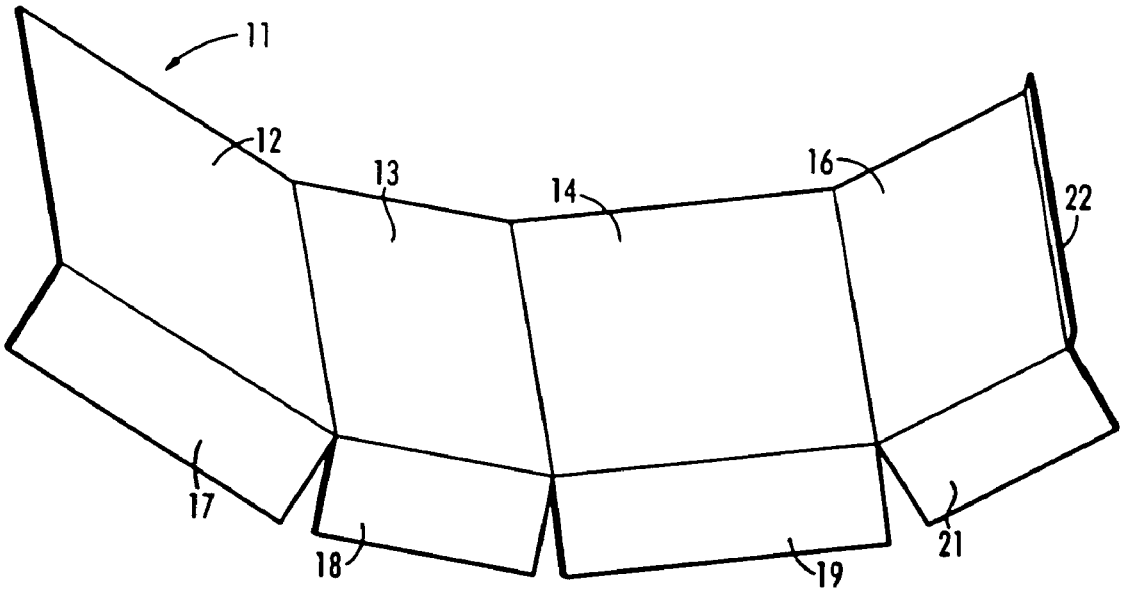
FIG. 1 shows a corrugated cardboard panel cut to form a container.

The drawings illustrate a special display container for flat box shaped air filters used in home heating and air conditioning systems and the steps of making the container and the manner of use of the container in displaying the air filter in a merchant's place of business. FIG. 1 shows a piece of conjugated card board component 11 cut and creased to form four quadrilateral sides 12, 13, 14, 16, four bottom flaps 17, 18, 19, 21 and a side flap 22.

Figure 2:
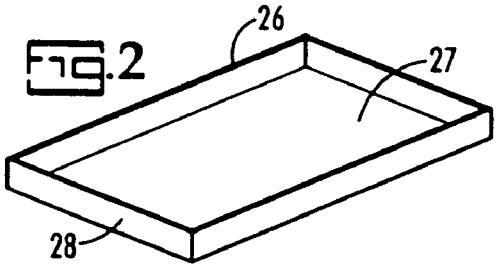
FIG. 2 shows a cap formed for the container.
Figure 3:
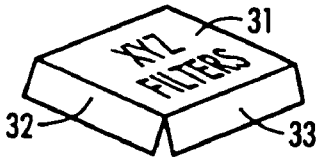
FIG. 3 shows an unattached information panel.

FIG. 2 shows a cap 26 having a quadrilateral top panel 27 and a rectangular collar 28 extending at right angles to the top panel 27. FIG. 3 shows an information panel 31 which preferably identifies the goods and the manufacturer by name and/or trademark and may also include other helpful information such as dimensions and model number. The information panel 31 is provided with a pair of flaps 32, 33 on adjacent sides of the panel 31.

Figure 4:
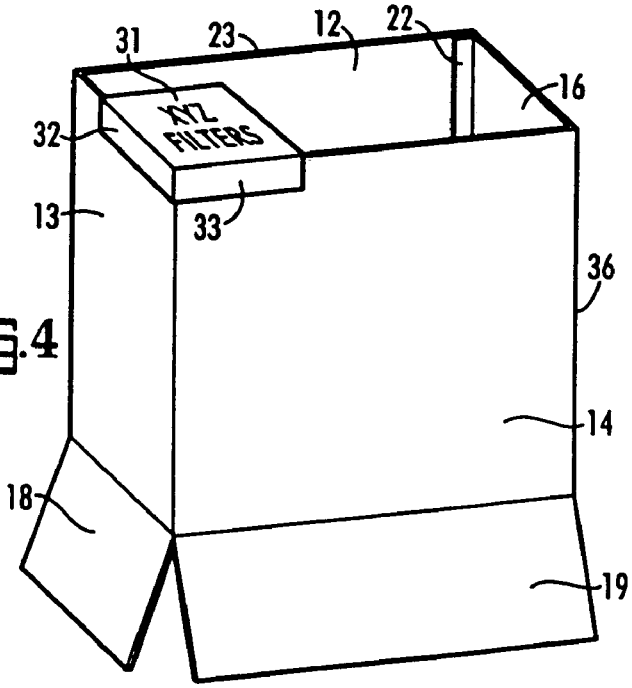
FIG. 4 shows the panel of FIG. 1 folded to form an enclosure with an open end to which the information panel is installed.
Figure 5:
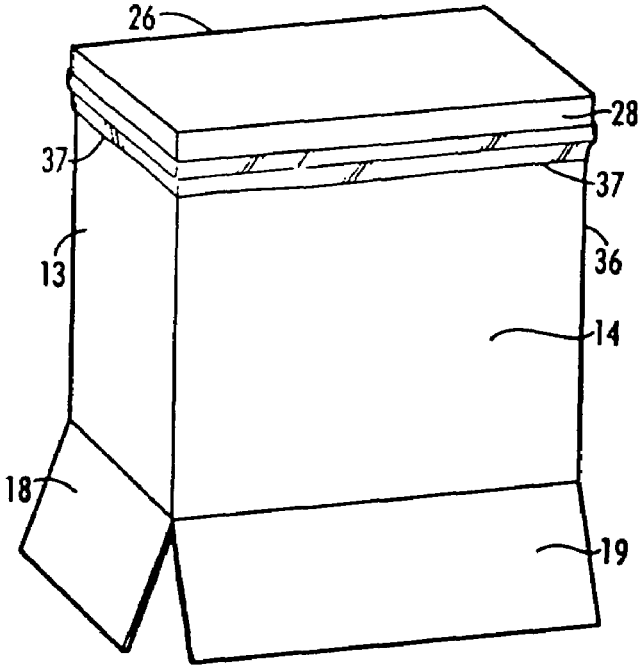
FIG. 5 shows the cap placed over the information panel at the open end.
Figure 6:
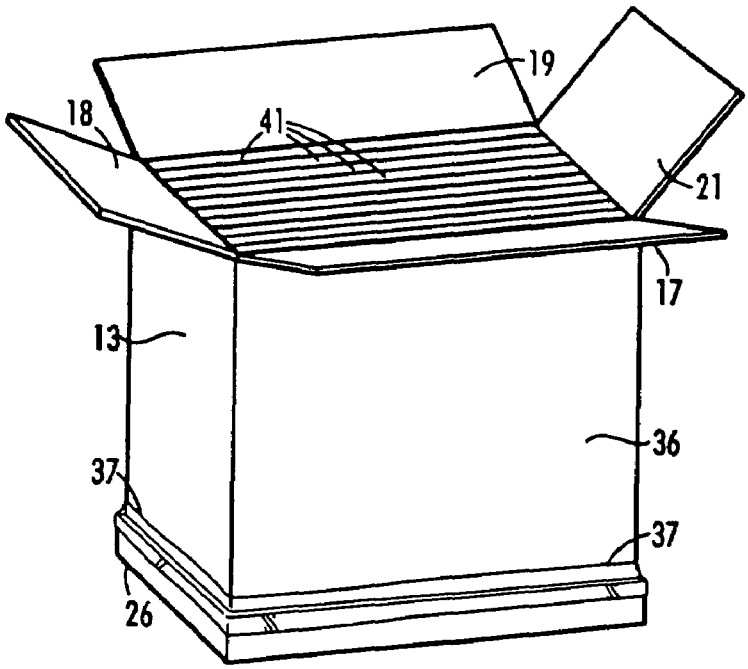
FIG. 6 shows the container in an inverted position with merchandise inserted therein.
Figure 7:
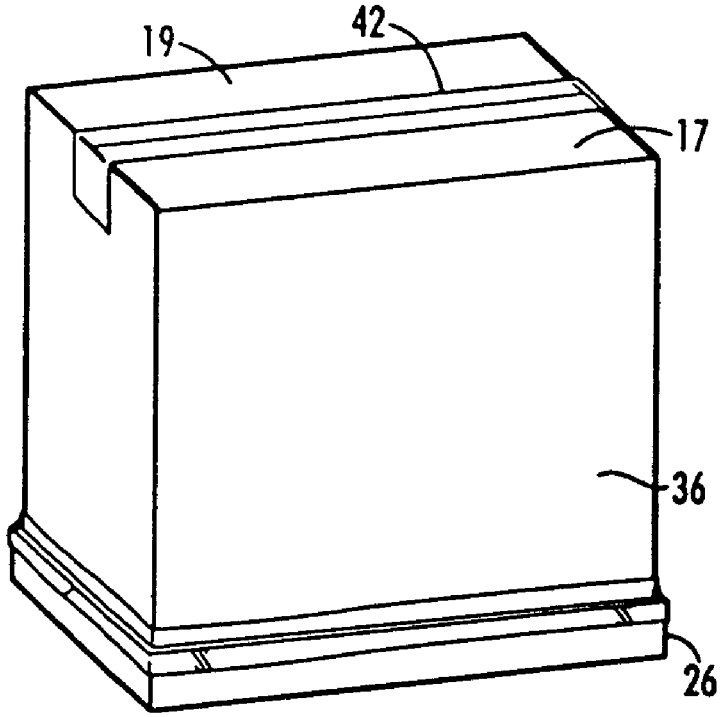
FIG. 7 shows the container sealed and ready for shipment or storage.
Figure 8:
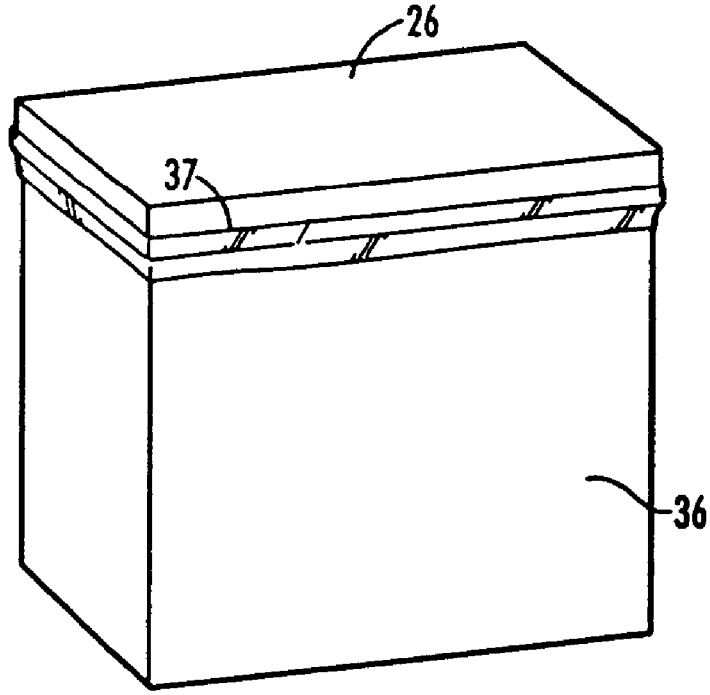
FIG. 8 shows the container positioned with its cap on top.

FIG. 4 shows an enclosure 36 being formed from the card board component 11 by gluing the flap 22 to the side 12 and also shows the information panel 31 secured in place in a corner of a rectangular opening 23 defined by the sides 12, 13, 14, 16. The flaps 32, 33 of the information panel 31 are glued, or otherwise secured, to the contiguous sides 13, 14 of the enclosure 36. In the next step in the process of manufacture of the container, which is illustrated in FIG. 5, the cap 26 is placed over the opening 23 and the information panel 31 and the collar 28 of the cap 26 fastened, preferably by transparent tape 37 to the sides 12, 13, 14, 16 of the component 11. The container thus formed is next turned upside down and a plurality of home type air filters 41 are inserted into the container as shown in FIG. 6. In the next step, the flaps 17, 18, 19, 21 are folded and secured by tape 42 to close the container, as shown in FIG. 7. FIG. 8 shows the filled container in an upright position ready for storage or shipment to a merchant.

Figure 9:
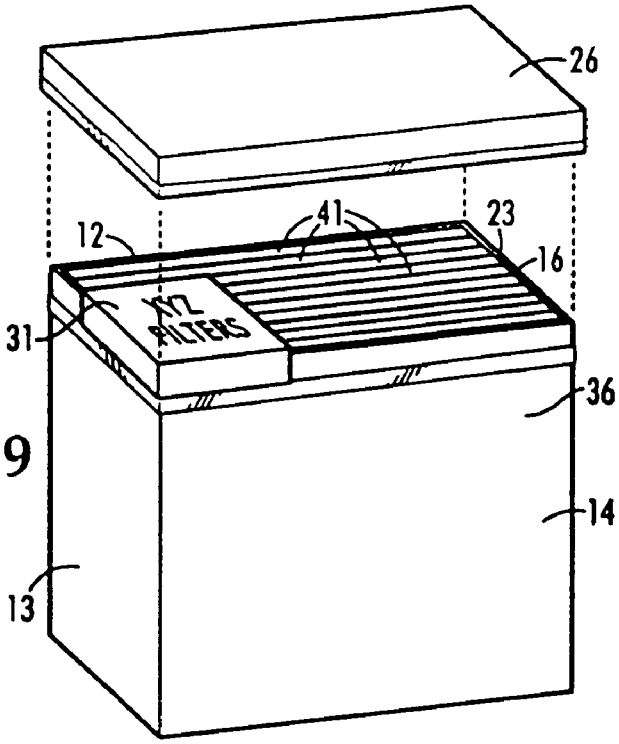
FIG. 9 shows the container with the cap removed.
Figure 10:
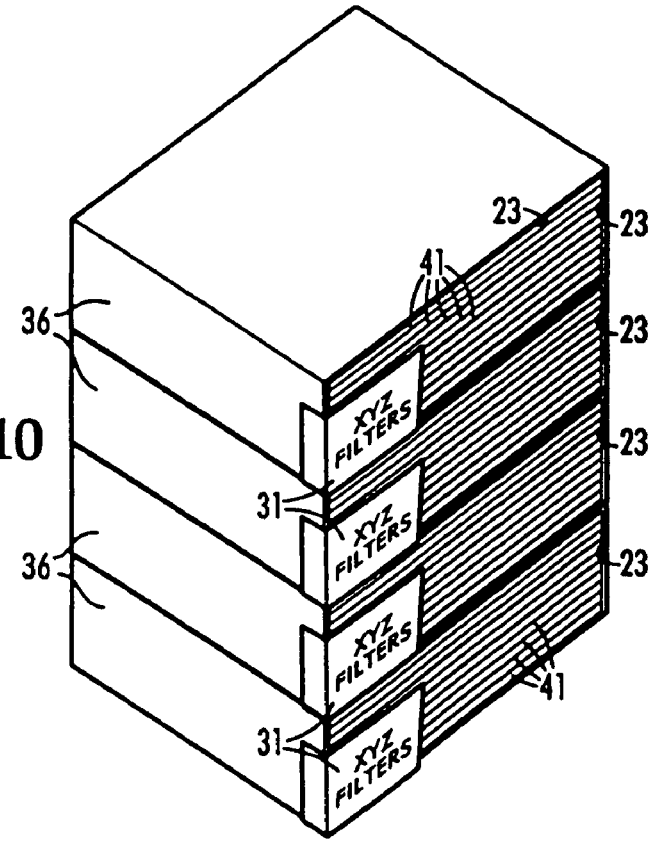
FIG. 10 shows a plurality of opened containers stacked one on top of another with the flat air filters therein lying horizontal.

After receipt of the merchandise by the retailer, the container may be opened by cutting the tape 37 by which the cap 26 is secured to the enclosure 36 and by removing the cap 26, as shown in FIG. 9. The enclosures may now be stacked for display of the juxtaposed filters 41 as shown in FIG. 10. The upper edge of information panels 31, positioned in the lower left hand corner of the opening 23, is parallel to the air filters 41 and parallel to the side 12 of the enclosures 36. This spacing of the upper edge of the information panel 31 from the side 12 of the enclosure 36 provides a gap of about two or three times the thickness of an air filter 41. The spacing permits a customer to easily remove the top air filter from an enclosure 36 without destructive effect on the information panel 31.

The herein disclosed method of packaging and displaying merchandise items provides protected movement of the merchandise from the point of manufacture to the selling merchant and also permits quick display and easy customer removal of merchandise items. The merchant markets the goods while they are protected by an enclosure and the customer is able to identify the product without removing the product from the enclosure. The information panel provides the information the customer needs to choose the correct replacement filter. The filter is easily removed without injury to other filters or the information panel. Although the drawings show air filters, the invention is believed to have application in packaging and merchandising other similar thin box shaped articles.

What is claimed is:

1. A method of packaging thin box-shaped articles for shipment and display comprising of steps of:

forming an enclosure having four rectangular shaped adjoined sides with edges defining a rectangular shaped top opening and bottom flaps for enclosing a bottom opening, securing adjacent edges of a rectangular shaped information panel to adjacent edges of said sides whereby said panel is disposed at one corner of said top opening with the other edges of said information panel spaced, respectively, from the other edges of said sides, securing a removable unitary enclosure cap to said enclosure in covering relation to said information panel and in covering relation to said top opening filling said enclosure with said articles through said bottom opening, and folding and securing said bottom flaps to close said bottom opening.

2. The method of claim 1 wherein said information panel is quadrilaterally shaped with bendable flaps on said adjacent edges of said panel and wherein said bendable flaps are secured to contiguous sides of said enclosure.

3. The method of claim 1 wherein said enclosure cap is removable thereby displaying said articles and said information panel and allowing removal of individual articles through said top opening.

* * * * *